US010283905B2

(12) United States Patent
Regnier et al.

(10) Patent No.: US 10,283,905 B2
(45) Date of Patent: May 7, 2019

(54) ELECTRICAL CONNECTOR ASSEMBLY

(71) Applicant: Aptiv Technologies Limited, St. Michael (BB)

(72) Inventors: Vincent Regnier, Spardorf (DE); Michael Gunreben, Schwanstetten (DE)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 15/949,284

(22) Filed: Apr. 10, 2018

(65) Prior Publication Data

US 2018/0316133 A1 Nov. 1, 2018

(30) Foreign Application Priority Data

Apr. 27, 2017 (EP) ..... 17168499

(51) Int. Cl.

| | |
|---|---|
| ***H01R 13/627*** | (2006.01) |
| ***H01R 13/635*** | (2006.01) |
| ***H01R 13/641*** | (2006.01) |
| ***H01R 13/625*** | (2006.01) |
| *H01R 13/639* | (2006.01) |

(52) U.S. Cl.

CPC ..... *H01R 13/6277* (2013.01); *H01R 13/625* (2013.01); *H01R 13/627* (2013.01); *H01R 13/6278* (2013.01); *H01R 13/635* (2013.01); *H01R 13/641* (2013.01); *H01R 13/639* (2013.01); *H01R 2201/26* (2013.01)

(58) Field of Classification Search

CPC ..... H01R 13/6277; H01R 13/6278; H01R 13/635; H01R 13/641; H01R 2201/26

USPC ..... 439/312

See application file for complete search history.

(56) References Cited

U.S. PATENT DOCUMENTS

| | | | | |
|---|---|---|---|---|
| 4,070,080 A * | 1/1978 | Eshleman | ..... | H01R 13/6271 439/345 |
| 4,464,001 A * | 8/1984 | Collins | ..... | H01R 13/625 439/318 |
| 5,080,600 A * | 1/1992 | Baker | ..... | H01R 13/633 439/258 |
| 5,895,282 A | 4/1999 | Little | | |

(Continued)

FOREIGN PATENT DOCUMENTS

| | | |
|---|---|---|
| DE | 3042185 A1 | 5/1981 |
| EP | 808749 A2 | 11/1997 |

(Continued)

*Primary Examiner* — Harshad C Patel

(74) *Attorney, Agent, or Firm* — Robert J. Myers

(57) ABSTRACT

An electrical connector assembly includes a plug with a plug body having a contact holder portion and an annular locking ring attached to the plug body. An elastic element holds the locking ring in a rest position. The locking ring has a first recess at a first end that creates a guide surface. The assembly also includes a mating connector having a plug-receiving portion configured to receive the contact holder portion of the plug. The plug-receiving portion includes a collar having a projection which, when mating the electrical plug and mating connector, engages the guide surface and rotates the locking ring. The locking ring has a second recess at a second end. The projection and the second recess are in a plane perpendicular to the plug-in axis in fully assembled state. The spring force rotates the locking ring and locks the plug body with the plug-receiving portion.

14 Claims, 5 Drawing Sheets

(56) References Cited

U.S. PATENT DOCUMENTS

| | | | | |
|---|---|---|---|---|
| 6,226,068 | B1 | 5/2001 | Arcykiewicz et al. | |
| 7,108,540 | B2 * | 9/2006 | Annecke | H01R 13/6275 439/352 |
| 8,215,977 | B2 * | 7/2012 | Zapf | H01R 13/6273 439/352 |
| 8,529,278 | B2 * | 9/2013 | Shiga | H01R 13/504 439/272 |
| 8,656,575 | B1 * | 2/2014 | Bulow | H01R 13/622 29/525.01 |
| 8,876,552 | B2 * | 11/2014 | Taguchi | H01R 24/54 439/582 |
| 9,821,671 | B2 * | 11/2017 | Mueller | B60L 11/1818 |
| 2004/0248454 | A1 * | 12/2004 | Gunreben | H01R 13/639 439/352 |
| 2007/0254518 | A1 * | 11/2007 | Nealle | H01R 13/6277 439/352 |
| 2014/0045361 | A1 * | 2/2014 | Gunreben | H01R 13/6273 439/345 |
| 2014/0273582 | A1 * | 9/2014 | Arcykiewicz | H01R 13/62 439/312 |

FOREIGN PATENT DOCUMENTS

| | | | |
|---|---|---|---|
| EP | 1127388 | A1 | 8/2001 |
| GB | 1113173 | A | 5/1968 |
| WO | 0117068 | A1 | 8/2000 |

* cited by examiner

ELECTRICAL CONNECTOR ASSEMBLY

CROSS-REFERENCE TO RELATED APPLICATION

This application claims the benefit under 35 U.S.C. § 119(a) of Patent Application No. 17168499.6 filed in the European Patent Office on Apr. 27, 2017, the entire disclosure of which is hereby incorporated by reference.

TECHNICAL FIELD OF THE INVENTION

The present invention relates to an electrical connector assembly particularly useful with airbag restraint systems.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
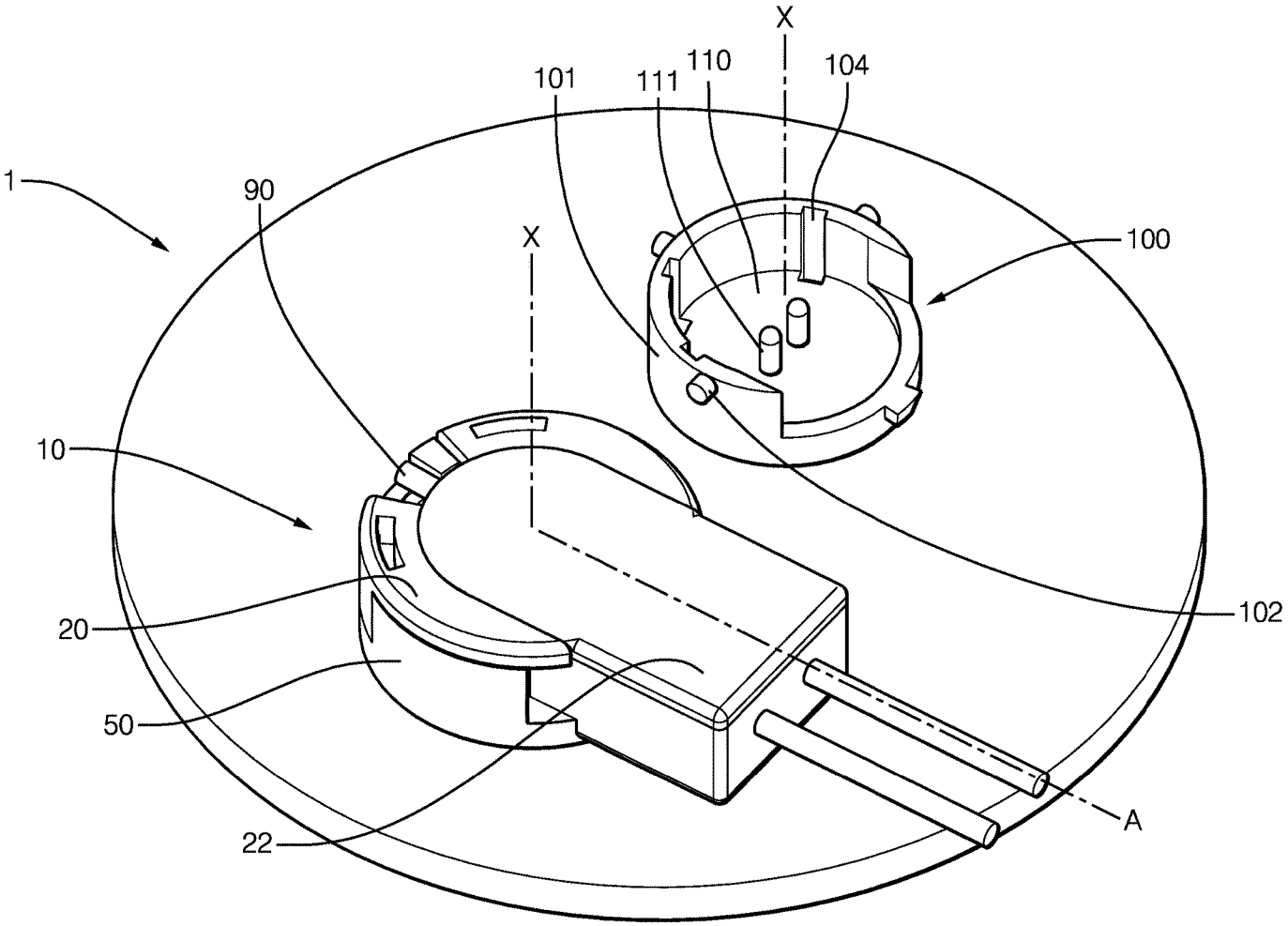
FIG. 1 shows the connector assembly in perspective view in accordance with an embodiment of the invention.

An electrical connector assembly for an airbag ignition mechanism shown in FIGS. 1 through 7*b* is described herein. The electrical connector assembly includes a plug 10 with a plug body 20 comprising a contact holder portion 30, an annular locking ring 50 movable about a plug-in axis, attached to the plug body 20 and concentrically surrounding the contact holder portion 30. An elastic element 90 that holds the locking ring 50 in a rest position. The locking ring 50 has at least a first recess 55 at a first end 53 extending opposite a direction of insertion diagonally to the plug 10-in axis, wherein it creates a guide surface 52. A mating connector 100 having a plug-receiving portion 110 configured to receive the contact holder portion 30 of the plug 10. The plug-receiving portion 110 is surrounded by a collar 101, on the outside of which a projection 102 is provided, which, when mating the electrical plug 10 and mating connector 100, engages the guide surface 52 and rotates the locking ring 50 against a spring force of the elastic element 90 about the plug-in axis in a first direction. The locking ring 50 has a second recess 56 at a second end 54. In fully assembled state, the projection 102 and the second recess 56 are in a plane perpendicular to the plug-in axis, wherein the spring force rotates the locking ring 50 against the first direction, so that the projection 102 is received in the second recess 56 and locks the plug body 20 with the plug-receiving portion 110.

This electrical connector assembly ensures that the plug 10 is only then locked to the mating connector 100 when it is fully inserted. If the plug 10 is not fully inserted, the plug 10 is pulled out of the mating connector 100 by the elastic element 90 when the insertion force is removed. The worker immediately sees that the plug 10 is not inserted correctly and may repeat the process. However, if the plug 10 is correctly inserted, the projections snap into the recesses 104 and securely lock the plug 10. The plug 10 is locked at several points to hold the plug 10 particularly firm against the mating connector 100. This locking concept allows to design very flat plug-in connectors.

Advantageous embodiments of the invention may be seen from the dependent claims, the description and the drawings.

According to one embodiment, a clearance 57 is formed between the contact holder portion 30 and the locking ring 50, which completely receives the collar 101 when the electrical plug 10 is inserted into the mating connector 100. This structure allows to form the connector assembly particularly flat and allows sufficient guidance between plug 10 and mating connector 100.

According to one embodiment, the contact holder portion 30 on its circumference facing said locking ring 50 comprises at least one rib 32 which is configured to engage at least one groove in the mating connector 100, while the electrical plug 10 is inserted into the mating connector 100. On the one hand, the interaction of the rib 32 and the groove allows a precise guidance of the plug 10 in the mating connector 100 and, on the other hand, the rib 32 holds the plug in position when the locking ring 50 is rotated about the plug-in axis. The rib 32 prevents displacement of the first plug 10 when the elastic element 90 causes torque about the plug-in axis.

According to another embodiment, the rib 32 engages the groove before the projection 102 engages the guide surface 52. For the rib 32-groove combination to hold the first housing part, upon insertion in the insertion direction, the rib 32 first has to engage the groove before the locking ring 50 is rotated.

According to one embodiment, a plurality of ribs 32 is distributed unevenly about the circumference. When using multiple rib 32-groove pairs, on the one hand, the retention capability increases, which makes the connector assembly more robust, on the other hand, this results in coding options for the connector assembly. As a result, connecting errors are avoided during assembly, as given plugs can only be connected to given mating connectors 100. This is particularly useful when several, same-looking mating connectors 100 are arranged side by side.

According to a further embodiment, the first recess 55 and the second recess 56 are provided on the inside of the locking ring 50. This has the advantage that the outside has a smooth surface that is dirt-repellent. The surface may also have corrugated areas to facilitate gripping when opening the connection. Further, the mechanism, consisting of guide surface 52 and projection 102, is protected against dirt and debris.

According to one embodiment, the elastic element 90 is formed as torsion spring. The design as a torsion spring may be integrated particularly well in the housing. The torsion spring is perpendicular to the plug-in axis and thus does not contribute to the expansion of the housing in the direction of the plug-in axis. If absolutely necessary, the elastic element 90 may certainly also be designed as spring or elastomer element. A promising embodiment of the elastic element 90 consists of a stamped spring element. The spring element is U-shaped or in the form of a circular arc.

According to a further embodiment, the torsion spring has at least one winding, which winds about the plug-in axis. This construction guarantees a uniform spring effect.

According to one embodiment, one end of the torsion spring is connected with the plug body 20 and the second end 54 is connected with the locking ring 50. As a result, plug body 20 and locking ring 50 can move elastically against each other.

According to one embodiment, the plug body 20 has a flat, elongate shape whose dimension along the housing axis, which is perpendicular to the plug-in axis, is larger than in the direction of the plug-in axis. Due to the flat shape of the plug body 20, it can be installed in confined spaces.

According to a further embodiment, the locking ring 50 comprises more than a first recess 55 and more than a second recess 56. By using a plurality of recesses 104, the pressure on the guide surfaces is reduced, which makes it easier for the locking ring 50 to slide and also provides increased retention force (as mentioned above).

According to one embodiment, the recesses 104 are evenly distributed about the circumference of the locking ring 50. This prevents the locking ring 50 from being misjudged or jammed when mating.

According to one embodiment, the guide surface 52 extends in a linear direction. A linear guide surface 52 requires a uniform force on the plug 10 when mating. If it is desired that the insertion force should vary, the guide surface 52 may be curved or stepped. The characteristic of the required insertion force may thus be varied within a wide range.

FIG. 1 shows an electrical connector assembly, wherein two mating connectors 100 are mounted side by side on a housing wall 1 of an airbag ignition mechanism. A plug 10 is connected to one of the mating connectors 100. The plug 10 has a plug body 20 comprising a contact holder portion 30 and an annular locking ring 50, movable about a plug-in axis X, attached to the plug body 20 and concentrically surrounding the contact holder portion 30. An elastic element 90 (FIG. 3) holds the locking ring 50 in a rest position P. The plug body 20 has a flat, elongate shape whose dimension along the housing axis A, which is perpendicular to the plug-in axis X, is larger than in the direction of the plug-in axis. The mating connector 100 comprises a plug-receiving portion 110 which is configured to receive and electrically and mechanically connect the contact holder portion 30 of the plug 10. The mating connector 100 comprises a collar 101 surrounding the plug-receiving portion 110. The collar 101 has an annular cross-section about the plug-in axis X. Contact pins 111 having an annular cross-section protrude from the plug-receiving portion 110 along the plug-in axis X. The contact pins 111 are aligned with the housing axis A. The mating connector 100, on the side facing the plug-receiving portion 110, comprises recesses 104 which are configured to receive ribs 32 (FIG. 2) of the plug 10.

Figure 2:
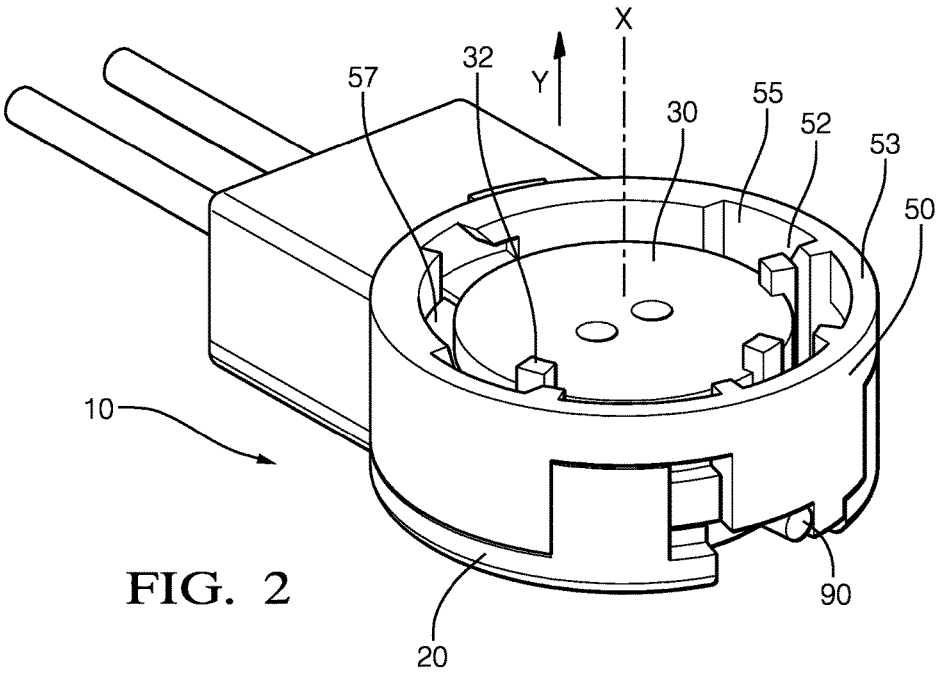
FIG. 2 shows the plug in perspective view in accordance with an embodiment of the invention.

FIG. 2 shows the plug 10 in a position which makes the contact holder portion 30 more visible. The locking ring 50 has a first recess 55 at a first end 53 extending opposite a direction of insertion Y diagonally to the plug-in axis X, wherein it creates a guide surface 52. A clearance 57 is provided between the contact holder portion 30 and the locking ring 50, which completely receives the collar 101 when the electrical plug 10 is inserted into the mating connector 100.

Figure 3:
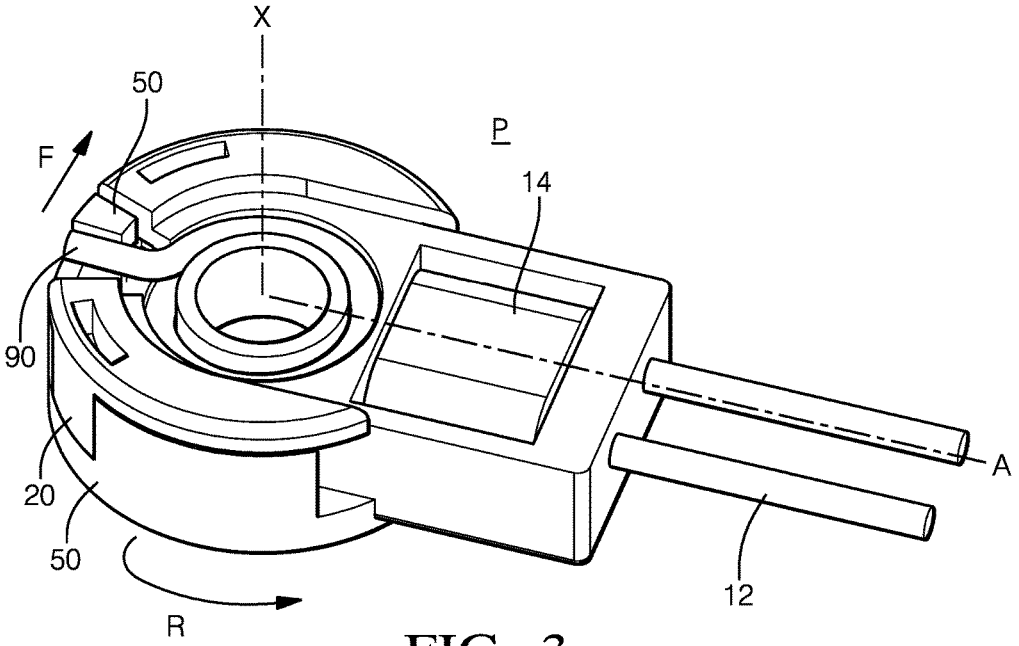
FIG. 3 shows the plug in perspective view (without housing cover) in accordance with an embodiment of the invention.

FIG. 3 shows the plug 10 in perspective view. The elastic element 90 engages both the plug body 20 and the locking ring 50. The elastic element 90 holds the locking ring 50 in a rest position P on the plug body 20 by exerting a force F on the locking ring 50. Thus, the locking ring 50 is prevented from rotating about the plug-in axis X.

Figure 4:
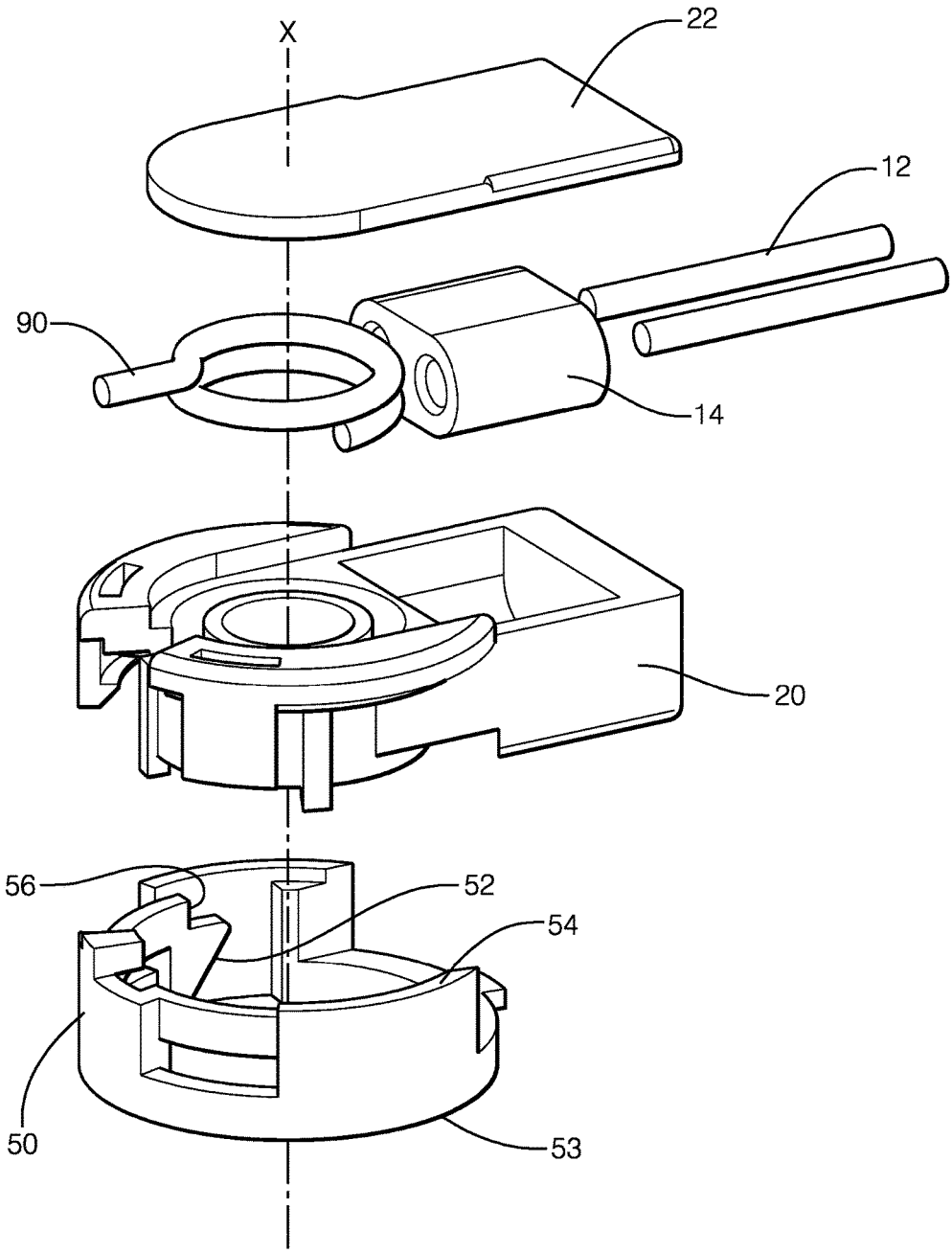
FIG. 4 shows the plug in an exploded view (contacts not shown) in accordance with an embodiment of the invention.

FIG. 4 shows the plug 10 in an exploded view. The elastic element 90 is held in the plug body 20 and partially wound about the plug-in axis X. The course of the electrical lines 12 is only hinted. A ferrite element 14 surrounds the electrical lines 12 and is also held in the plug body 20. A cover 22 covers the plug body 20. The locking ring 50 has a first recess 55 at a first end 53 extending opposite a direction of insertion Y diagonally to the plug-in axis, wherein it creates a guide surface 52. The locking ring 50 has a second recess 56 at a second end 54.

Figure 5:
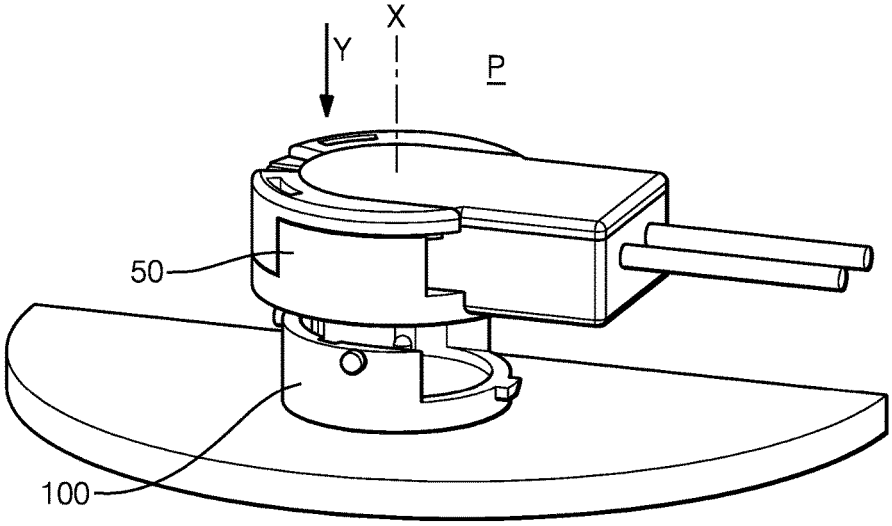
FIG. 5 shows the connector assembly in perspective view, with plug and mating connector separated in accordance with an embodiment of the invention.

FIG. 5 shows the electrical connector assembly in a position wherein the plug 10 and the mating connector 100 are aligned with the plug-in axis X, but the insertion process has not yet begun. The plug 10 is in its rest position P.

Figure 6A:
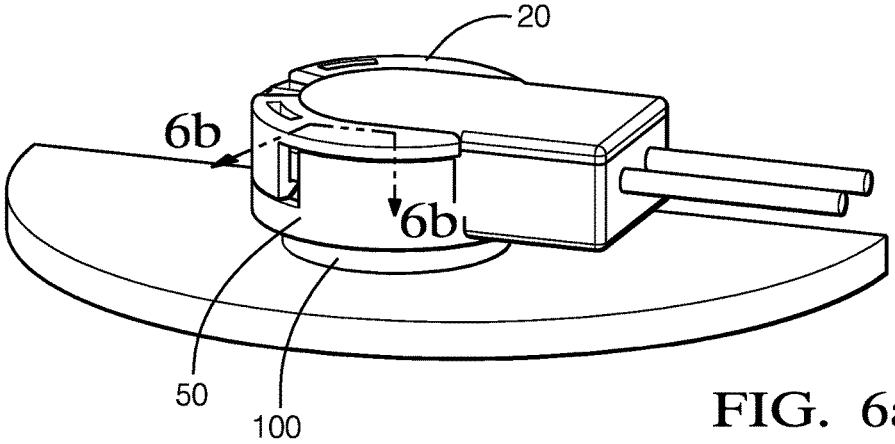
FIGS. 6*a* and 6*b* show the connector assembly in perspective view in a position at the beginning of the insertion process in accordance with an embodiment of the invention.
Figure 6B:
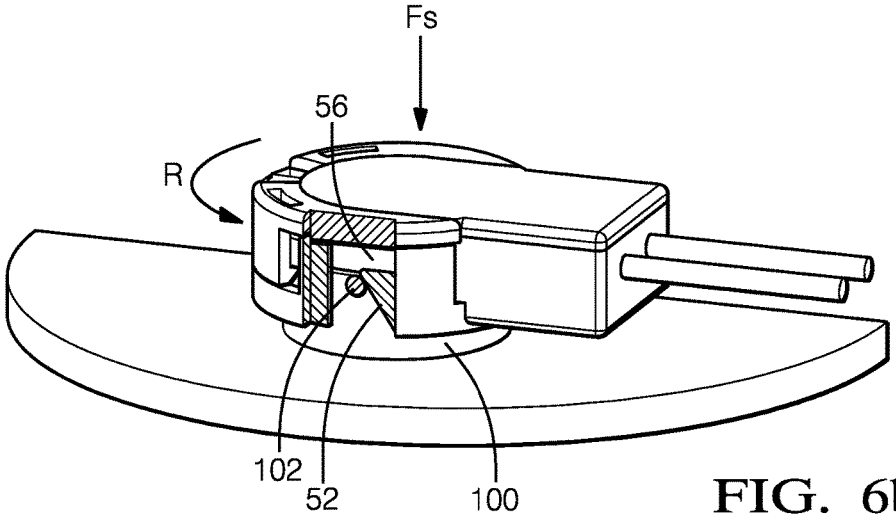

FIG. 6*b* shows a sectional view of a section along the sectional axis C of FIG. 6*a*. FIGS. 6*a*, 6*b* show the plug 10 and the mating connector 100, wherein both are aligned with the plug-in axis X, and the insertion process begins. A portion of the rib 32 on the plug 10 is received within the recess 104 of the mating connector 100 and limits the freedom of movement about the plug-in axis X (not shown). The guide surface 52 of the plug 10 and the projection 102 of the mating connector 100 are abutting each other. The projection 102 and the inclined guide surface 52 act against each other so that the locking ring 50 is rotated in a direction R against the spring force F about the plug-in axis X. The insertion force Fs overcomes the effect of the force F of the elastic element 90.

Figure 7A:
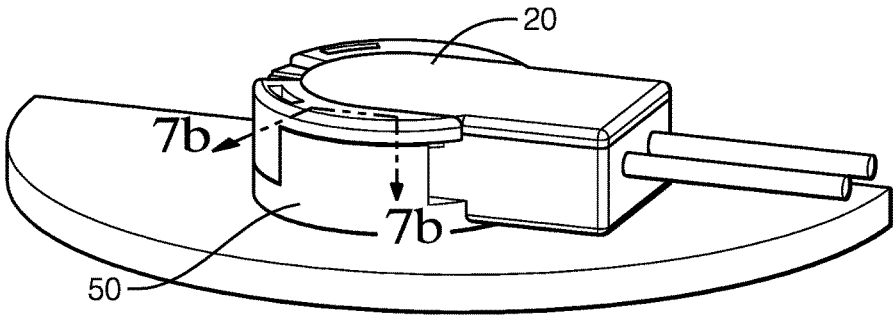
FIGS. 7*a* and 7*b* show the connector assembly in perspective view in the final position in accordance with an embodiment of the invention.
Figure 7B:
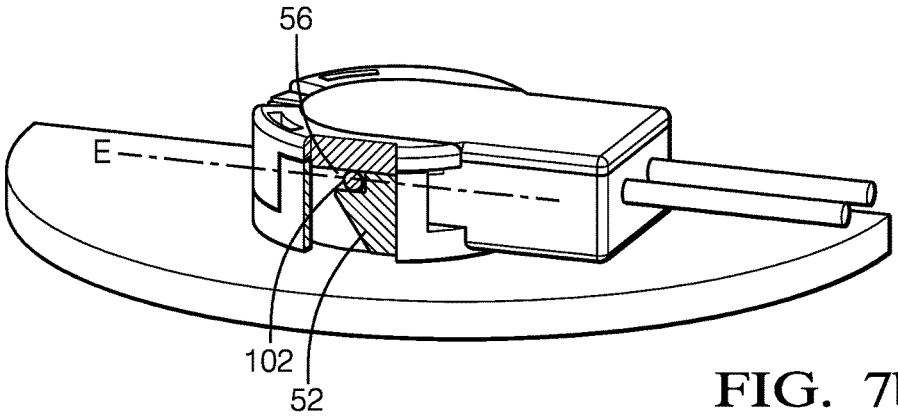

FIG. 7*b* shows a sectional view of a section along the sectional axis C of FIG. 7*a*. FIGS. 7*a*, 7*b* show the plug 10 and the mating connector 100 in fully mated condition. The projection 102 is located in an end plane E with the second recess 56. The elastic element 90 has pulled the second recess 56 (part of the locking ring 50) into the final position and locked the plug body 20 with the mating connector 100.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

That while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising;

a plug with a plug body comprising a contact holder portion;

an annular locking ring movable about a plug-in axis, attached to the plug body, and concentrically surrounding the contact holder portion, wherein an elastic element holds the locking ring in a rest position and wherein the locking ring has a first recess at a first end extending opposite a direction of insertion diagonally to the plug-in axis, wherein it creates a guide surface; and a mating connector having a plug-receiving portion configured to receive the contact holder portion of the plug, wherein the plug-receiving portion is surrounded by a collar, on the outside of which a projection is provided, which, when mating the plug and the mating connector, engages the guide surface and rotates the locking ring against a spring force of the elastic element about the plug-in axis in a first direction, wherein the locking ring has a second recess at a second end, wherein the projection and the second recess are in a plane perpendicular to the plug-in axis in fully assembled state, wherein the spring force rotates the locking ring against the first direction, so that the projection is received in the second recess and locks the plug body with the plug-receiving portion.

2. The electrical connector assembly according to claim 1, wherein a clearance is formed between the contact holder portion and the locking ring that completely receives the collar when the plug is inserted into the mating connector.

3. The electrical connector assembly according to claim 1, wherein a circumference of the contact holder portion facing said locking ring comprises a rib which is configured to engage a groove in the mating connector while the plug is inserted into the mating connector.

4. The electrical connector assembly according to claim 3, wherein the rib engages the groove before the projection engages the guide surface.

5. The electrical connector assembly according to claim 4, wherein a plurality of ribs is distributed unevenly about the circumference.

6. The electrical connector assembly according to claim 1, wherein the first recess and the second recess are provided on the inside of the locking ring.

7. The electrical connector assembly according to claim 1, wherein the elastic element is formed as torsion spring.

8. The electrical connector assembly according to claim 7, wherein the torsion spring has a winding that winds about the plug-in axis.

9. The electrical connector assembly according to claim 8, wherein one end of the torsion spring is connected with the plug body and the second end is connected with the locking ring.

10. The electrical connector assembly according to claim 1, wherein the plug body has a flat, elongate shape having a first dimension along a housing axis perpendicular to the plug-in axis, is larger than a second dimension in a direction of the plug-in axis.

11. The electrical connector assembly according to claim 1, wherein the first and second recesses are evenly distributed about a circumference of the locking ring.

12. The electrical connector assembly according to claim 1, wherein the guide surface extends in a linear direction.

13. The electrical connector assembly according to claim 1, wherein the guide surface extends in a curved manner.

14. The electrical connector assembly according to claim 1, wherein an angle at which the guide surface extends opposite to an insertion direction varies along the plug-in axis.

* * * * *